US011566827B2

(12) United States Patent
Turner

(10) Patent No.: US 11,566,827 B2
(45) Date of Patent: Jan. 31, 2023

(54) MIXED REFRIGERANT CONDENSER OUTLET MANIFOLD SEPARATOR

(71) Applicant: Chart Energy & Chemicals, Inc., Ball Ground, GA (US)

(72) Inventor: Peter J. Turner, The Woodlands, TX (US)

(73) Assignee: Chart Energy & Chemicals, Inc., Ball Ground, GA (US)

( * ) Notice: Subject to any disclaimer, the term of this patent is extended or adjusted under 35 U.S.C. 154(b) by 63 days.

(21) Appl. No.: 16/130,185

(22) Filed: Sep. 13, 2018

(65) Prior Publication Data

US 2019/0078820 A1 Mar. 14, 2019

Related U.S. Application Data

(60) Provisional application No. 62/558,706, filed on Sep. 14, 2017.

(51) Int. Cl.
*F25B 43/00* (2006.01)
*F25B 9/00* (2006.01)
(Continued)

(52) U.S. Cl.
CPC ..... *F25B 43/006* (2013.01); *F25B 9/006* (2013.01); *F25B 39/04* (2013.01); *F25B 41/00* (2013.01);
(Continued)

(58) Field of Classification Search
CPC ..... F25B 43/006; F25B 43/00; F25B 9/006; F25B 39/04; F25B 41/00; F25B 2400/23;
(Continued)

(56) References Cited

U.S. PATENT DOCUMENTS 4,181,174 A * 1/1980 Grenier ..... F25J 1/0022 165/180
5,597,037 A 1/1997 Asada et al.
(Continued)

FOREIGN PATENT DOCUMENTS

DE 303754 A1 2/1982
JP H 04-29703 A 1/1992
(Continued)

OTHER PUBLICATIONS

International Search Report and Written Opinion of the International Searching Authority for PCT Appl. No. PCT/US2018/050891 dated Dec. 6, 2018.
(Continued)

*Primary Examiner* — Tavia Sullens
(74) *Attorney, Agent, or Firm* — Cook Alex Ltd.

(57) ABSTRACT

A system for condensing and phase separating a refrigerant fluid includes a condenser inlet header configured to receive a stream of refrigerant vapor. A condenser is in fluid communication with the condenser header and is configured to receive vapor and produce a mixed phase fluid stream. An elongated manifold separator including multiple mixed phase inlets is configured to separate mixed phase fluid received from the condenser. Resulting vapor and liquid streams exit vapor and liquid outlets of the manifold separator.

16 Claims, 9 Drawing Sheets

(51) Int. Cl.

| | |
|---|---|
| ***F25B 39/04*** | (2006.01) |
| ***F25B 41/00*** | (2021.01) |
| ***F25J 1/00*** | (2006.01) |
| ***F25J 1/02*** | (2006.01) |

(52) U.S. Cl.
CPC ..... *F25B 43/00* (2013.01); *F25J 1/0022* (2013.01); *F25J 1/0055* (2013.01); *F25J 1/0212* (2013.01); *F25B 2400/23* (2013.01); *F25J 2205/02* (2013.01); *F25J 2270/66* (2013.01)

(58) Field of Classification Search
CPC ..... F25J 1/0022; F25J 1/0055; F25J 1/0052; F25J 1/0212; F25J 1/0211; F25J 2205/02; F25J 2270/66
See application file for complete search history.

(56) References Cited

U.S. PATENT DOCUMENTS

| | | | | |
|---|---|---|---|---|
| 5,724,833 | A * | 3/1998 | Devers | F25J 1/0022 62/625 |
| 6,318,116 | B1 | 11/2001 | Gabel et al. | |
| 2010/0031697 | A1 | 2/2010 | Hinde et al. | |
| 2015/0316333 | A1 | 11/2015 | Davies et al. | |
| 2016/0271542 | A1 | 9/2016 | Huff et al. | |
| 2017/0010043 | A1 | 1/2017 | Ducote, Jr. et al. | |

FOREIGN PATENT DOCUMENTS

| | | | | |
|---|---|---|---|---|
| JP | H0618165 | A | 1/1994 | |
| JP | H07243760 | A | 9/1995 | |
| JP | 2000320933 | A | 11/2000 | |
| JP | 2000337732 | A | 12/2000 | |
| JP | 2003004343 | A | 1/2003 | |
| JP | 2004211949 | A | 7/2004 | |
| JP | 2004308968 | A | 11/2004 | |
| JP | 2008196721 | A | 8/2008 | |
| JP | 4191847 | B2 | 12/2008 | |
| JP | 2015-034637 | A | 2/2015 | |
| JP | 2016180548 | A | 10/2016 | |
| WO | WO-2013076971 | A * | 5/2013 | F25B 43/00 |

OTHER PUBLICATIONS

European Office Action dated Oct. 21, 2022 for European Application No. 18783211.8.
Notice of Reasons for Rejection for Japanese Patent Application No. 2020-515111 dated Jul. 8, 2022.

* cited by examiner

MIXED REFRIGERANT CONDENSER OUTLET MANIFOLD SEPARATOR

CLAIM OF PRIORITY

This application claims the benefit of U.S. Provisional Application No. 62/558,706, filed Sep. 14, 2017, the contents of which are hereby incorporated by reference.

FIELD OF THE INVENTION

The present disclosure relates generally to refrigerant fluid processing systems and, in particular, to a condenser outlet manifold and system for separating phases of a mixed refrigerant.

BACKGROUND

Gases, such as natural gas, are often liquefied for storage and transport. Systems for liquefying gases typically chill the gas through indirect heat exchange with a refrigerant in a heat exchanger (which is typically inside a "cold box"). Efficiency in terms of energy usage is a primary issue for liquefaction systems. Use of a mixed refrigerant in the refrigeration cycle(s) for the system increases efficiency in that the warming curve of the refrigerant more closely matches the cooling curve of the gas.

The refrigeration cycle for the liquefying system will typically include a compression system for conditioning or processing the mixed refrigerant. Processing of the mixed refrigerant may include separating liquid and vapor phases so that they may be directed to portions of the heat exchanger to provide more efficient cooling. Examples of such systems are provided in commonly owned U.S. Pat. No. 9,441,877 to Gushanas et al., U.S. Patent Application Publication No. US 2014/0260415 to Ducote, Jr. et al. and U.S. Patent Application Publication No. US 2016/0298898 to Ducote, Jr. et al., the contents of each of which are hereby incorporated by reference.

A mixed refrigerant compression system typically includes one or more stages, with each stage including a compressor, a condenser and a separation and liquid accumulator device. Vapor exiting the compressor is cooled in the condenser, and the resulting two-phase or mixed phase stream is directed to the separation and liquid accumulator device, from which vapor and liquid exit for further processing and/or direction to the liquefaction heat exchanger.

With reference to FIGS. 1 and 2, in prior art mixed refrigerant (MR) liquefaction system designs, the MR refrigeration compressor discharge is generally air-cooled in a bank of multiple air cooler bays containing tube bundles 20*a*, 20*b*, 20*c* and 20*d*. The compressor discharge is initially directed to an inlet distribution header 22 and is distributed to the air cooler tube bundles via lines 24*a*, 24*b*, 24*c* and 24*d*. The two-phase or mixed phase air cooler outlet streams from each tube bundle are routed to a collection header 26 via lines 28*a*, 28*b*, 28*c* and 28*d* and then sent to a large MR separation and liquid accumulator vessel (MR Accumulator) 32 via line 34. The MR Accumulator 32 includes a separator inlet device 36, and liquid is directed to the bottom of the MR Accumulator 32 while vapor is directed to the top. The vapor exits the top of the MR Accumulator 32 through line 38 and travels to the liquefaction cold box 42 (and to the heat exchanger inside) for use in cooling the gas being liquefied via indirect heat exchange. Liquid exits the bottom of the MR Accumulator 32 through line 44 and travels to the cold box 42 (and to the heat exchanger inside), also for use in cooling the gas.

While the components of FIGS. 1 and 2 perform well, plot layout simplification, reduced pressure drop in the MR compression circuit and reduced cost are desirable.

SUMMARY

Figure 1:
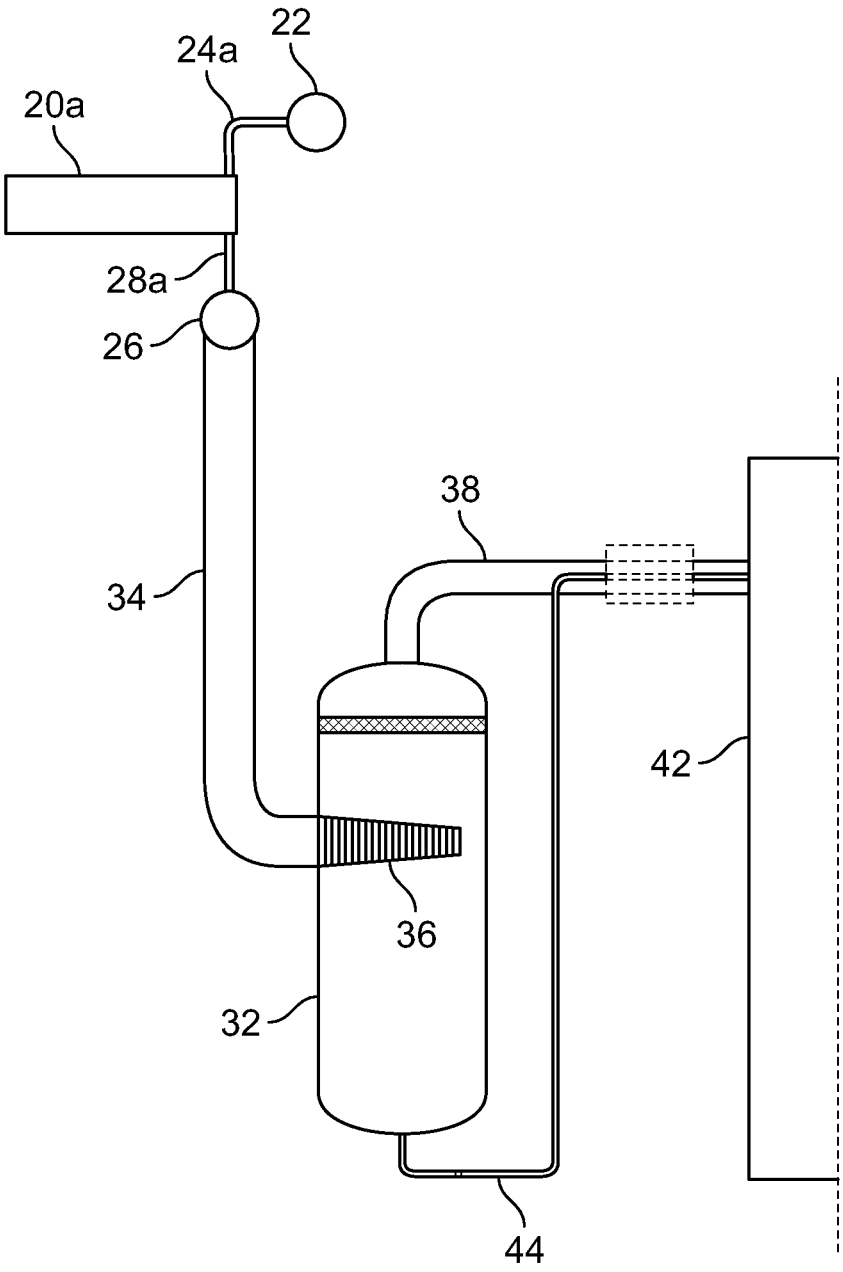
Fig. 1 (Prior Art)
FIG. 1 is a side view of a process flow diagram and schematic illustrating a prior art condenser and mixed refrigerant separator and accumulator system.

There are several aspects of the present subject matter which may be embodied separately or together in the devices and systems described and claimed below. These aspects may be employed alone or in combination with other aspects of the subject matter described herein, and the description of these aspects together is not intended to preclude the use of these aspects separately or the claiming of such aspects separately or in different combinations as set forth in the claims appended hereto.

In one aspect, a system for condensing and phase separating a refrigerant fluid includes a condenser inlet header configured to receive a stream of refrigerant vapor. The condenser inlet header also has a condenser header outlet. The system also has a condenser having a vapor inlet in fluid communication with the condenser header outlet and a mixed phase fluid outlet. The condenser is configured to receive vapor through the vapor inlet and to produce a mixed phase fluid stream that exits the condenser through the mixed phase outlet. An elongated manifold separator including multiple mixed phase inlets is in fluid communication with the mixed phase outlet of the condenser. The manifold separator is configured to separate mixed phase refrigerant fluid received through the mixed phase inlet into vapor and liquid and includes a vapor outlet through which a resulting vapor stream exits the manifold separator and a liquid outlet through which a resulting liquid stream exits the manifold separator. A vapor collection header having an inlet is configured to receive a vapor stream from the manifold separator vapor outlet and also has a vapor collection header outlet. A liquid collection header having an inlet is configured to receive a liquid stream from the manifold separator liquid outlet and also has a liquid collection header outlet.

In another aspect, a manifold separator has an elongated body defining a separation chamber and includes multiple mixed phase inlets configured so that a mixed phase refrigerant fluid is received within the separation chamber. The body also includes a vapor outlet configured so that a vapor stream may exit the separation chamber and a liquid outlet configured so that a liquid stream may exit the separation chamber.

In still another aspect, a liquefaction system includes a liquefaction heat exchanger having one or more refrigeration passages, a warm end and a cold end. The liquefaction heat exchanger is configured to receive a feed gas at the warm end, to liquefy the gas, and to dispense the liquefied gas from the cold end. The liquefaction system also includes a compression system having a condenser inlet header configured to receive a stream of refrigerant vapor. The condenser inlet header also has a condenser header outlet. The system also has a condenser having a vapor inlet in fluid communication with the condenser header outlet and a mixed phase fluid outlet. The condenser is configured to receive vapor through the vapor inlet and to produce a mixed phase fluid stream that exits the condenser through the mixed phase outlet. An elongated manifold separator including multiple mixed phase inlets is in fluid communication with the mixed phase outlet of the condenser. The manifold separator is configured to separate mixed phase refrigerant fluid received through the mixed phase inlet into vapor and liquid and includes a vapor outlet through which a resulting vapor stream exits the manifold separator and a liquid outlet through which a resulting liquid stream exits the manifold separator. A vapor collection header having an inlet is configured to receive a vapor stream from the manifold separator vapor outlet and also has a vapor collection header outlet that is in fluid communication with one of the one or more refrigeration passages of the heat exchanger. A liquid collection header having an inlet is configured to receive a liquid stream from the manifold separator liquid outlet and also has a liquid collection header outlet that is in fluid communication with one of the one or more refrigeration passages of the heat exchanger.

DETAILED DESCRIPTION OF EMBODIMENTS

Figure 3:
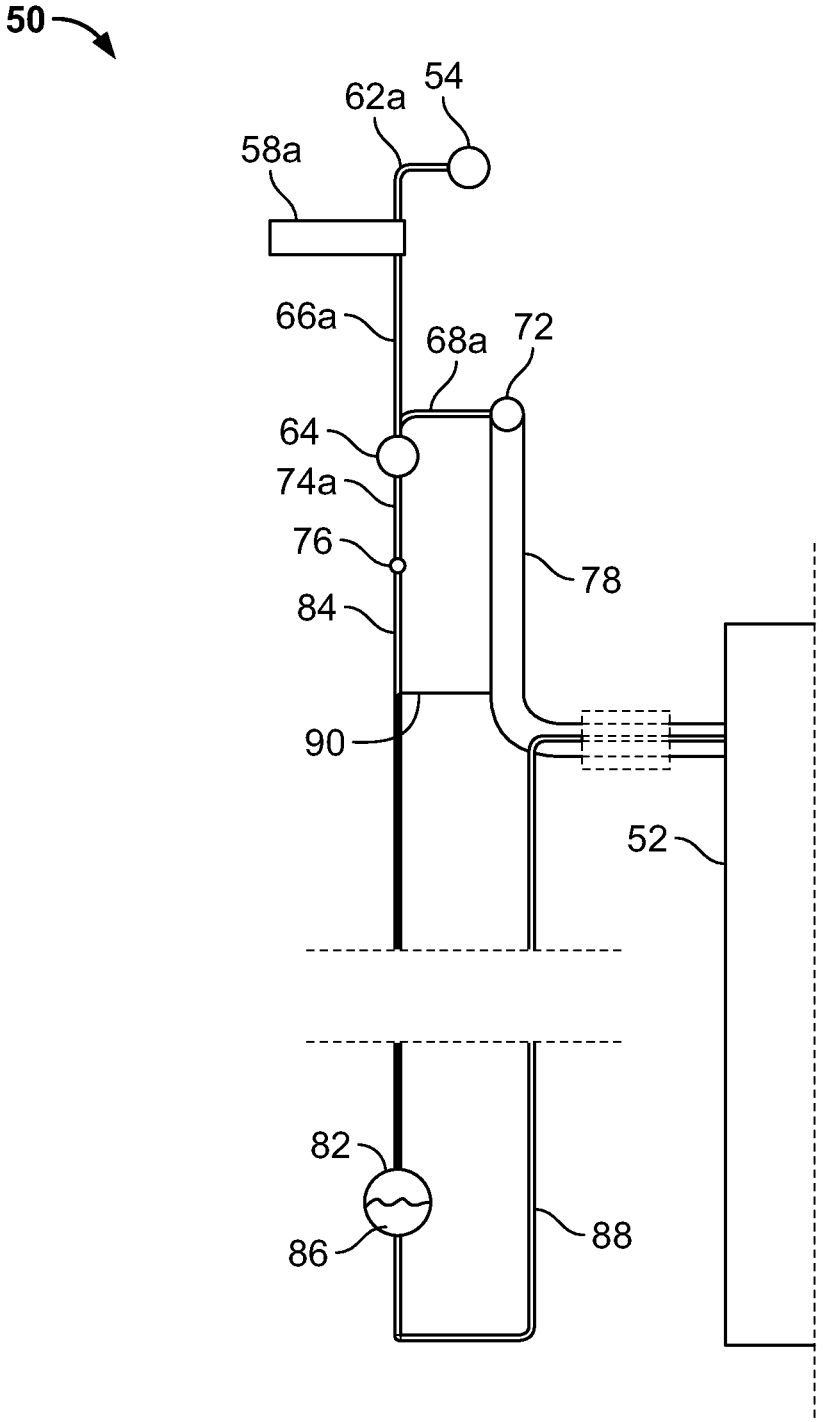
FIG. 3 is a side view of a process flow diagram and schematic illustrating a condensing and separating system that includes an embodiment of the mixed refrigerant condenser outlet manifold separator of the disclosure.
Figure 4:
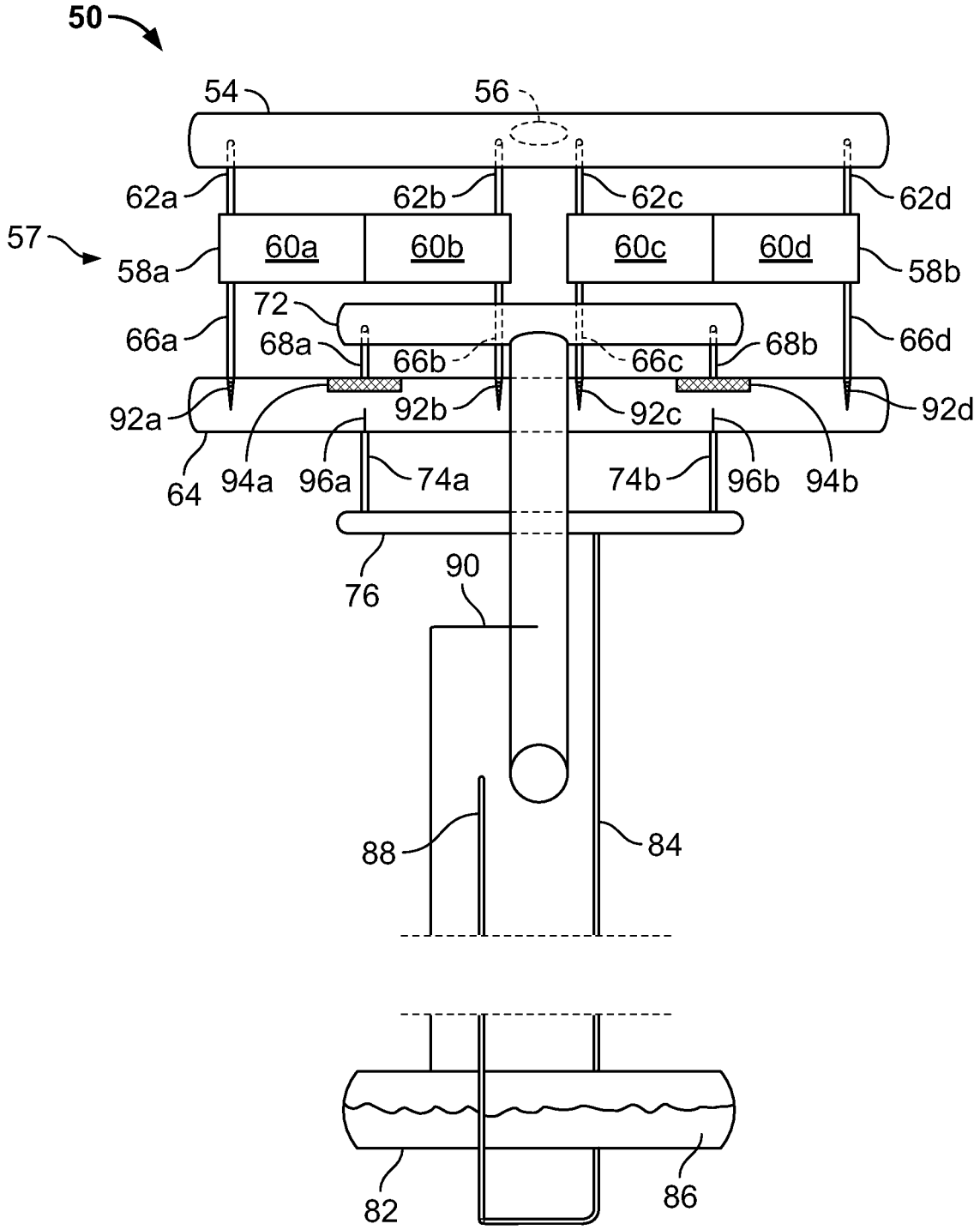
FIG. 4 is a front view of the process flow diagram and schematic of FIG. 3.

A mixed refrigerant condensing and separating system is indicated in general at 50 in FIGS. 3 and 4. A compressor (FIG. 13) receives mixed refrigerant vapor that has been warmed in a liquefaction heat exchanger optionally positioned within a cold box (52 in FIG. 3) and directs it into a condenser inlet distribution header 54, such as via inlet 56 (indicated in phantom in FIG. 4).

A condenser receives the vapor from the condenser inlet distribution header 54. As an example only, the condenser may include a pair of heat exchangers indicated in general at 58*a* and 58*b*. Of course an alternative number of heat exchangers may be used for the condenser, including one heat exchanger or more than two heat exchangers.

Heat exchangers 57 are preferably air cooled heat exchangers (ACHX) that feature multiple tube bundles 60*a*, 60*b*, 60*c* and 60*d* in air cooler bays 58*a* and 58*b*. The tube bundles of the heat exchangers receive the vapor from condenser inlet distribution header 54 via piping lines 62*a*, 62*b*, 62*c* and 62*d*. As an example only, suitable ACHX include CSC, HAPPY, ESEX and TRI-THERMAL forced draft and induced draft models available from Chart Industries, Inc. of Canton, Ga.

The terms line, piping and pipe are used interchangeably throughout the disclosure and indicate structure capable of carrying a stream of fluid.

The heat exchangers may instead be water cooled, or other types of condensers or heat exchangers known in the art may alternatively be used.

The resulting two-phase or mixed phase outlet streams from the condenser tube bundles 60*a*, 60*b*, 60*c* and 60*d* are routed to an elongated condenser outlet manifold separator 64 via piping or lines 66*a*, 66*b*, 66*c* and 66*d*. The manifold separator includes a body that defines an interior separation chamber which receives the mixed phase stream from piping 66*a*-66*d* through corresponding inlets formed in the manifold separator body. While the manifold separator is shown as having a generally pipe-shaped body (with closed ends) and thus a cylindrical separation chamber, the manifold may alternatively use other geometries.

Upon arrival in the manifold separator 64, the two-phase or mixed phase streams separate into liquid, which collects in the bottom of the manifold separator, and vapor, which collects in the headspace above the liquid in the manifold separator.

Vapor from the headspace of the elongated manifold separator 64 travels via vapor outlet pipes 68*a* and 68*b* to a vapor collection header 72 after exiting the separation chamber of the manifold separator through vapor outlets formed in the top portion of the manifold separator body. The liquid from the bottom of the manifold separator 64 travels via liquid outlet pipes 74*a* and 74*b* to a liquid collection header 76 after exiting the separation chamber of the manifold separator through liquid outlets formed in the bottom portion of the manifold separator body.

The vapor is routed from the vapor collection header 72 to a corresponding passage in the liquefaction heat exchanger/cold box 52 via piping 78 for use in liquefying a gas passing through the heat exchanger, or cooling in preparation for such use. The liquid from the liquid collection header 76 is routed to a mixed refrigerant liquid surge drum or vessel 82 via piping 84. As indicated at 86 in FIGS. 3 and 4, a quantity of the liquid pools in the surge drum or vessel 82. The liquid from the surge drum 82 is routed to a corresponding passage in the liquefaction heat exchanger/cold box 52 via piping 88 for use in liquefying a gas passing through the heat exchanger, or cooling in preparation for such use.

The liquid surge drum 82 may be of horizontal (as illustrated) or vertical design and is not restricted in its location. It can be located independently at grade, in a pipe rack or module, or inside a cold box, so long as it is located such that its highest intended liquid fill level is below the elevation of the manifold separator 64.

A pressure equalization line, indicated at 90 in FIGS. 3 and 4, extends from the top of the mixed refrigerant liquid surge drum 82 to either the line 78, which leads from the vapor collection header 72 to the cold box, or vapor collection header 72.

The manifold separator 64 is equipped with at least one mixed phase inlet per bundle 60*a*-60*d* with a minimum of two inlets total from the bundles in each of the bays 58*a* and 58*b*. The inlet may be a bare nozzle or it may optionally be equipped with a separator inlet device 92*a*-92*d* (FIG. 4), such as a baffle plate, vane-type separator inlet device or other separator inlet device known in the art. Suitable separator inlet devices include, but are not limited to, the SHELL SCHOEPENTOETER and TREEINLET devices available from Sulzer Chemtech of Winterthur, Switzerland.

Figure 5:
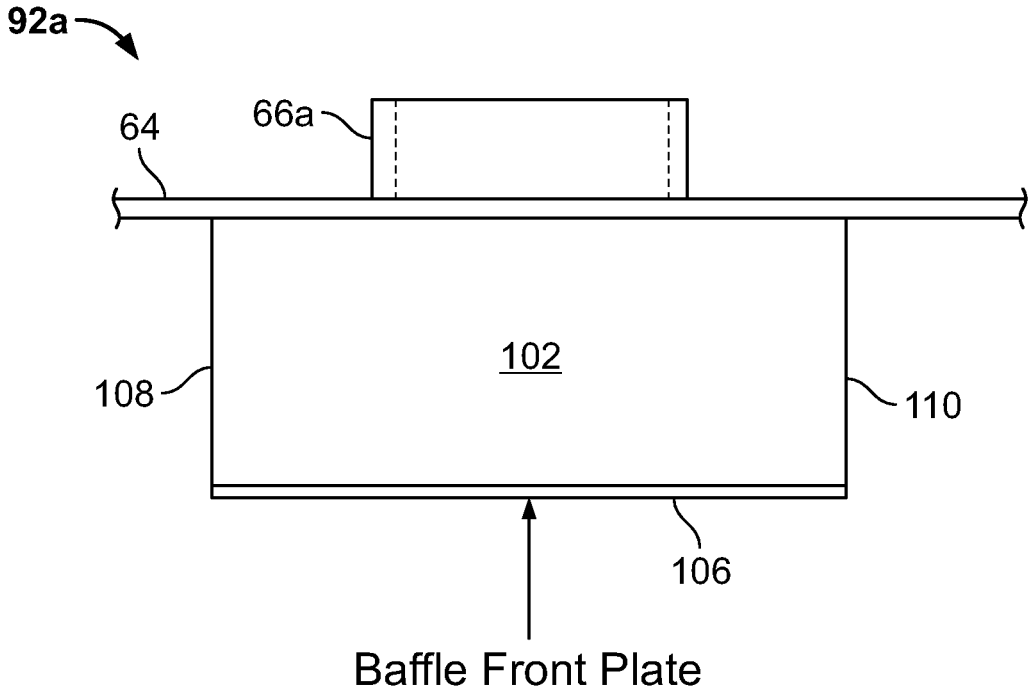
FIG. 5 is a top view of a baffle plate separator inlet device in an embodiment of the mixed refrigerant condenser outlet manifold separator of the disclosure.
Figure 6:
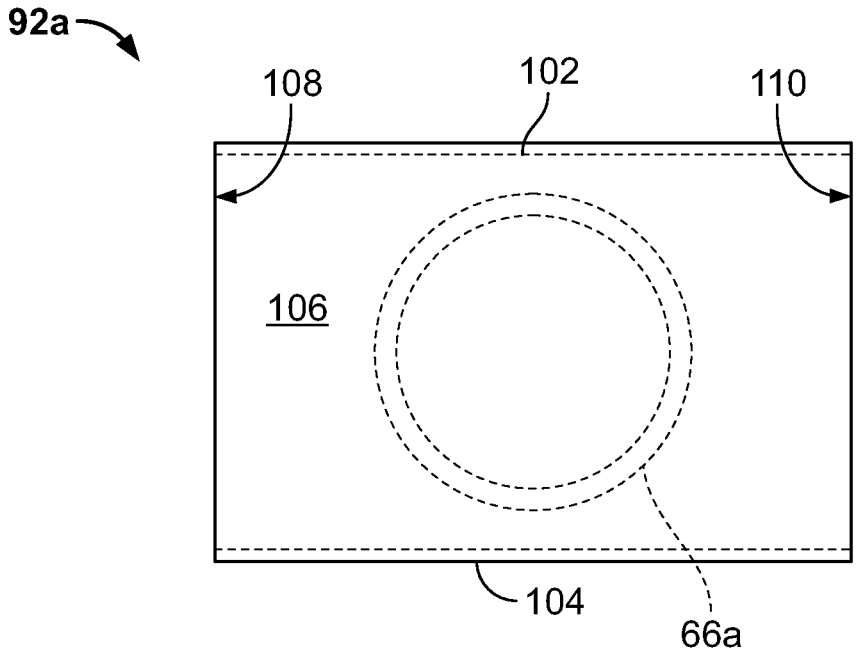
FIG. 6 is a front view of the baffle plate separator inlet device of FIG. 5.

Another example of separator inlet device is a baffle plate separator inlet device, an example of which is indicated in general at 92*a* in FIGS. 5 and 6 (inlet separator devices 92*b*-92*d* may feature similar constructions). A top view of the device is provided in FIG. 5 while a front view of the device is provided in FIG. 6. With such a device, the inlet pipe 66*a* would actually enter the back side (the side opposite the front side illustrated in FIG. 4) of the manifold separator 64. The baffle plate inlet device features a box-like structure with open ends. More specifically a top plate 102 and a bottom plate 104 each extend into the interior of the manifold separator 64 in a parallel fashion from the interior surface of the wall of the manifold separator 64. A front plate 106 joins the distal ends of the top and bottom plates 102 and 104 so that a pair of open sides 108 and 110 are defined.

Figure 7:
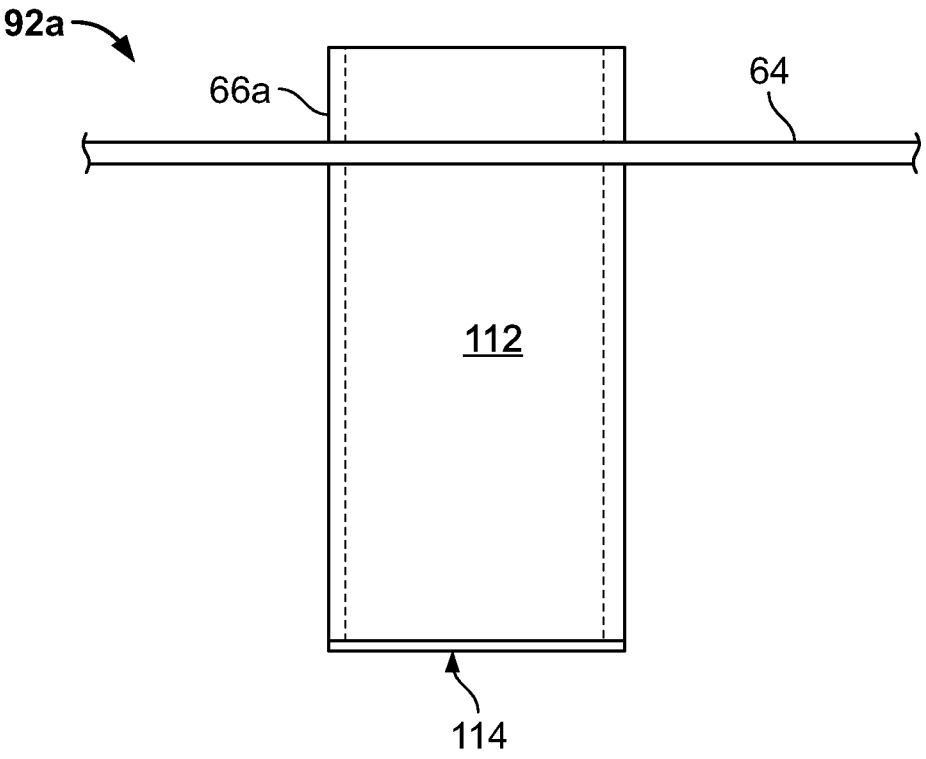
FIG. 7 is a top view of a half-pipe separator inlet device in an embodiment of the mixed refrigerant condenser outlet manifold separator of the disclosure.
Figure 8:
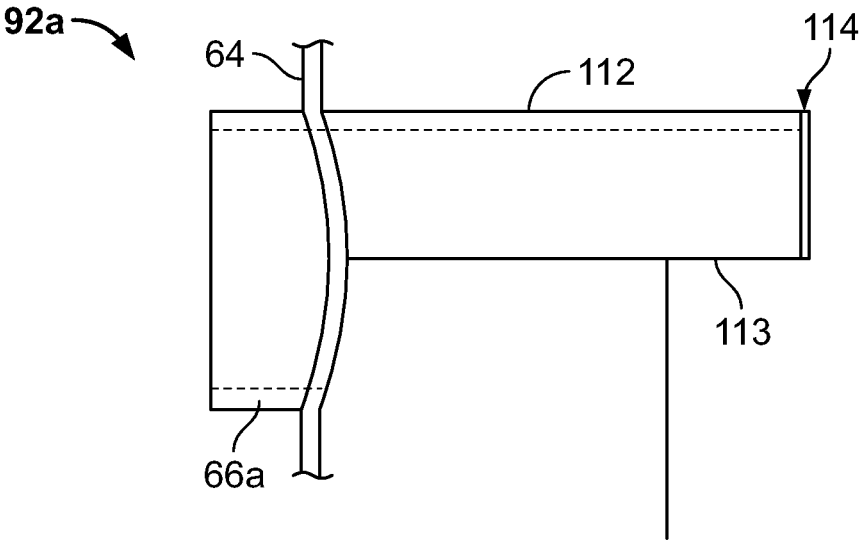
FIG. 8 is a side view of the half-pipe separator inlet device of FIG. 7.

Another example of a separator inlet device is a half pipe separator inlet device, an example of which is indicated in general at 92*a* in FIGS. 7 and 8 (inlet separator devices 92*b*-92*d* may feature similar constructions). A top view of the device is provided in FIG. 7 and a side view of the device is provided in FIG. 8. With such a device, the inlet pipe 66*a* would actually enter the back side (the side opposite the front side illustrated in FIG. 4) of the manifold separator 64. The half pipe inlet device features an arcuate shaped hood 112 that extends into the interior of the manifold separator 64 from the interior surface of the wall of the manifold separator 64 so that an open bottom 113 is defined. A semi-circular front plate 114 closes the inner end of the hood.

For each condenser bay, the manifold separator inlets or inlet nozzles are preferably similarly positioned, such as being placed at the outer edges of each bundle or the outer edges of each bay (as illustrated in FIG. 4). This results in, when moving horizontally across the inlet nozzles (going either right to left or left to right), alternating distances between the nth and n+1th inlet nozzles, with a long distance to the next inlet nozzles for odd n, and a short distance to the next inlet nozzles for even n. For example the horizontal distance from the nozzle featuring inlet device 92*a* to the nozzle featuring inlet device 92*b* is much longer than the horizontal distance between the nozzle featuring inlet device 92*b* and the nozzle featuring inlet device 92*c*.

The vapor and liquid outlet nozzles of the manifold separator 64 (which communicate with lines 68*a*-68*b* and 74*a*-74*b*, respectively) are placed in the long distances between the inlet nozzles (which communicate with lines 66*a*-66*d*). These outlet nozzles are sized for the full flow of each phase from the two closest inlet nozzles.

The vapor outlets of the manifold separator may optionally be equipped with outlet nozzles with (or without) vapor/liquid disengagement devices 94*a* and 94*b*, which may be, as examples only, mesh pads, vane packs or other mist elimination devices known in the art including, but not limited to, the KNITMESH, KNITMESH V-MISTER, MELLACHEVRON and SHELL SWIRLTUBE mist eliminators available from Sulzer Chemtech of Winterthur, Switzerland.

Figure 9:
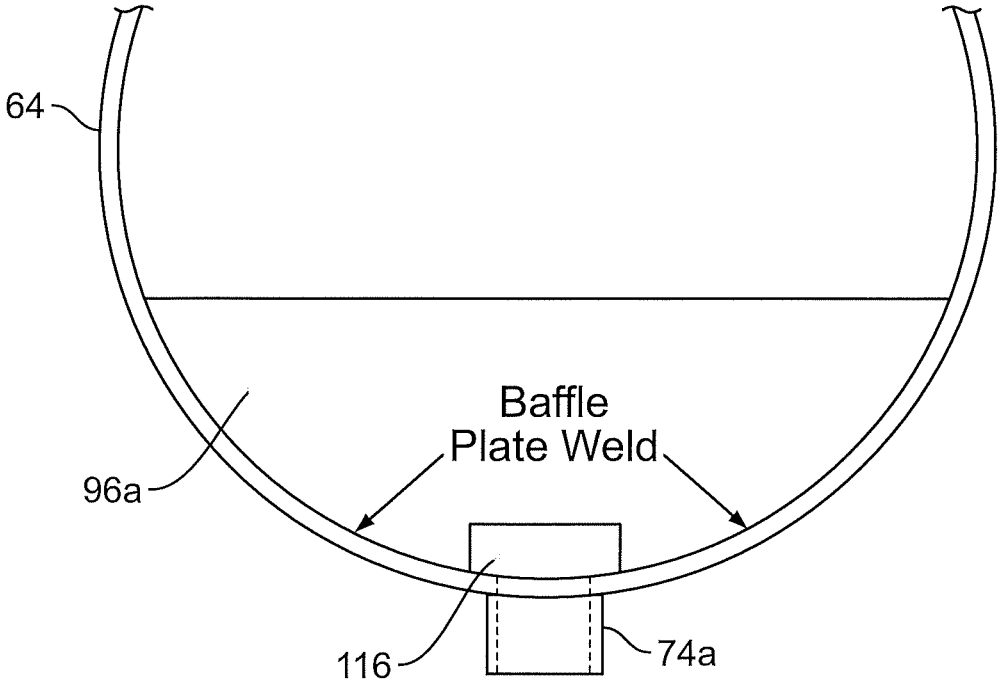
FIG. 9 is a side view of a liquid baffle plate in an embodiment of the mixed refrigerant condenser outlet manifold separator of the disclosure.
Figure 10:
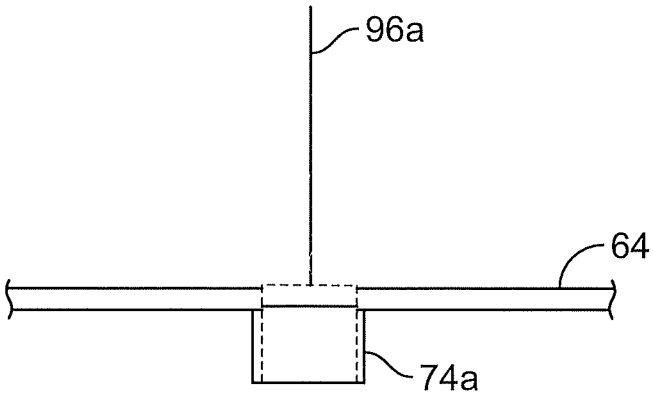
FIG. 10 is a front view of the liquid baffle plate of FIG. 9.

As illustrated in FIGS. 4, 9 and 10, the liquid outlets of the manifold separator may optionally be provided with outlet nozzles with (or without) baffles 96*a* and 96*b* placed over them, perpendicular to the longitudinal axis of the module separator 64, to account for motion in offshore applications or uneven installation. The baffle plates 96*a* and 96*b* are preferably provided with generally rectangular cutouts (shown at 116 for plate 96*a* in FIG. 9) to provide a nozzle space that is open to both sides of the baffle plate.

Figure 12:
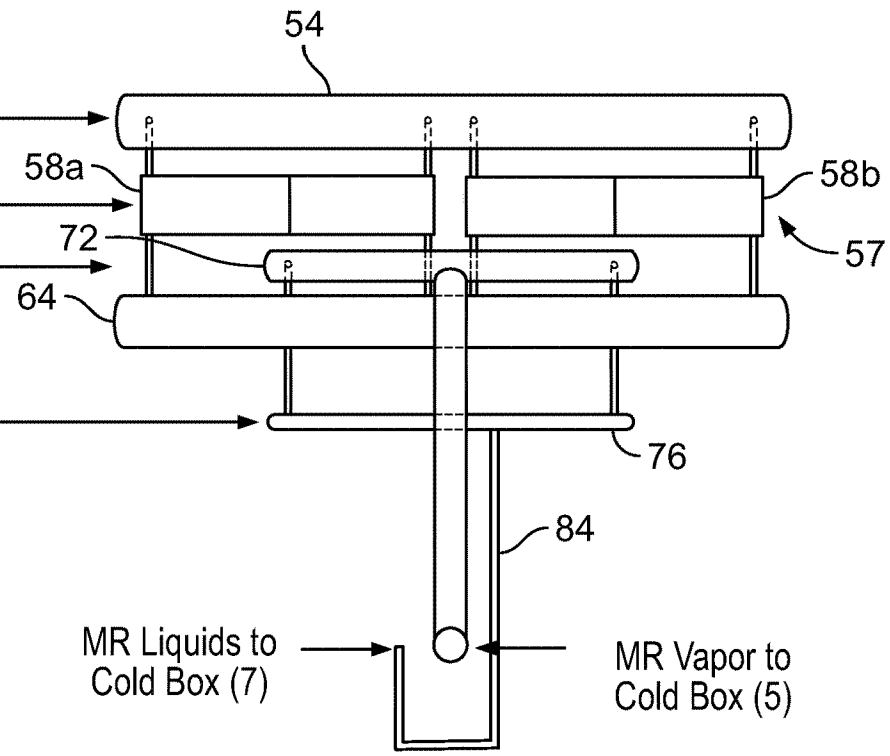
FIG. 12 is a front view of the process flow diagram and schematic of FIG. 11.
Figure 11:
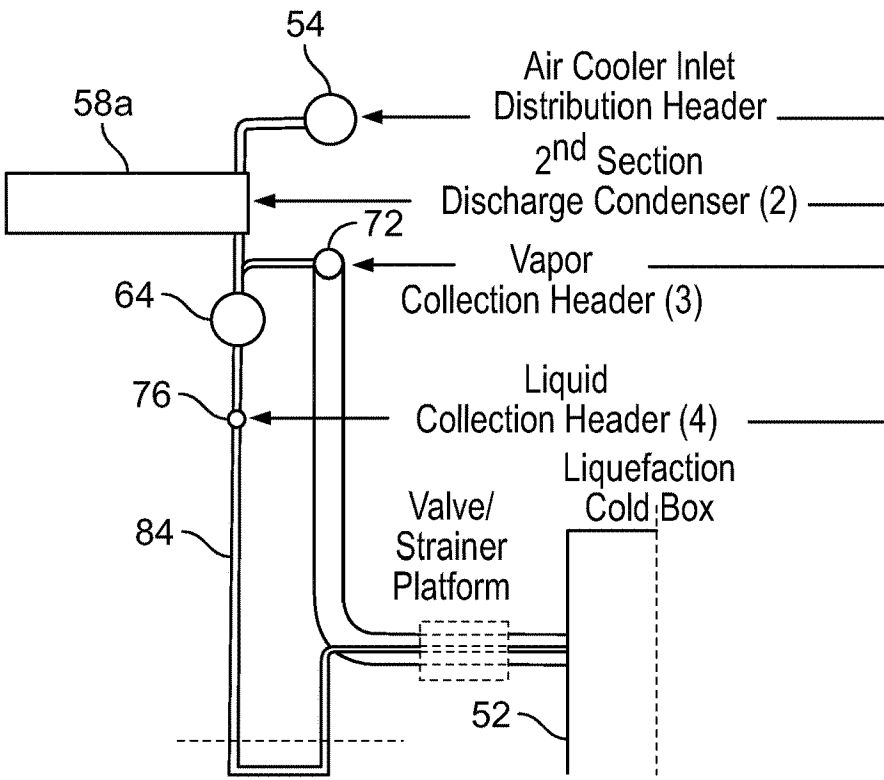
FIG. 11 is a side view of a process flow diagram and schematic illustrating a condensing and separating system that includes an embodiment of the mixed refrigerant condenser outlet manifold separator of the disclosure.

As illustrated in FIGS. 11 and 12, the mixed refrigerant condensing and separating system of FIGS. 3 and 4 may be constructed so that the liquid surge drum 82 is omitted. In such an embodiment, the line 84 exiting the bottom of the liquid collection header 76 runs directly to the corresponding passage in the liquefaction heat exchanger 52. In addition, as illustrated in FIG. 12, the separation inlet devices 92*a*-92*d* of FIG. 4 may be omitted from the manifold separator 64. The mist elimination devices 94*a* and 94*b* and the liquid baffles 96*a* and 96*b* of FIG. 4 may also be omitted from the manifold separator 64, as illustrated in FIG. 12.

An example of a prior art mixed refrigerant compression system within which the manifold separator and the mixed refrigerant condensing and separating systems described above may be used is presented in FIG. 13. In the compression system of FIG. 13, there are two distinct services or stages. For the first stage, at the discharge of the first section 120 of the mixed refrigerant compressor, the vapor is cooled and partially condensed and then separated with the liquid being routed to a dedicated passage of the liquefaction heat exchanger. The separated vapor is routed to the suction inlet of the mixed refrigerant compressor 2nd section 122. For the second stage, at the discharge of the 2nd section 122 of the mixed refrigerant compressor, the vapor is cooled and partially condensed and then separated with the liquid and vapor each being routed to a dedicated passage of the liquefaction heat exchanger. The prior art components located within the dashed blocks 124 and 126 of FIG. 13 were described above with reference to FIGS. 1 and 2. In accordance with the disclosure, the components of FIGS. 3 and 4 (minus the heat exchanger 52) or the components of FIGS. 11 and 12 (minus the heat exchanger 52) may instead be used to provide the components within the dashed blocks 124 and 126 of FIG. 13.

Figure 13:
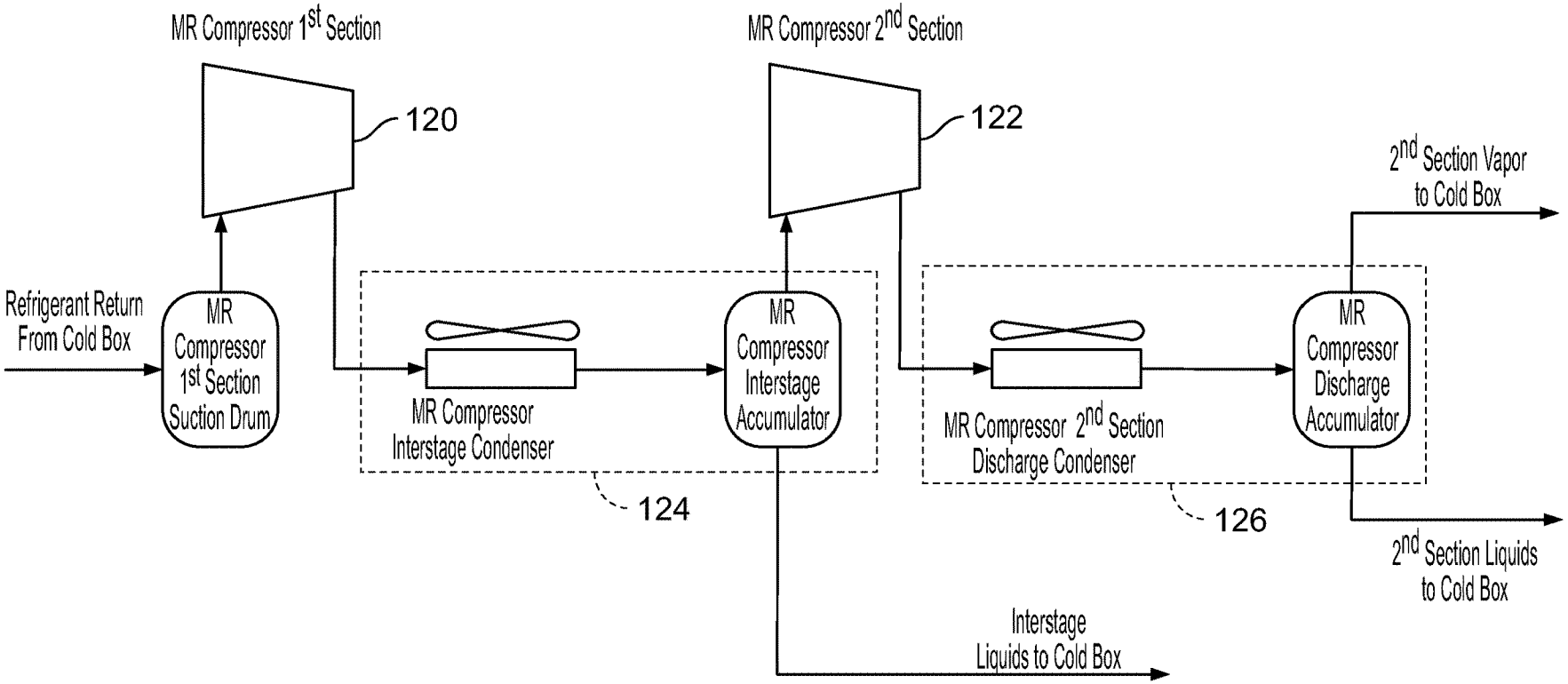
FIG. 13 is a simplified process flow diagram and schematic of a mixed refrigerant compression system.

While FIG. 13 is directed to a two-stage compression system of a liquefaction process, the innovations of the disclosure may be employed for any service in which a multi-bay air-cooled (or other coolant) condenser is followed by a vapor-liquid separator.

The above embodiments of the manifold separator of the disclosure therefore serve as a multi-inlet, multi-outlet horizontal separator along the length of the condenser (air cooler bank in the illustrated embodiments). Essentially, the manifold separator performs the separation function of the conventional mixed refrigerant accumulator, while the mixed refrigerant liquid surge drum performs the liquid storage function of the conventional mixed accumulator.

The proportions and orientation of the manifold separator 64 may be varied from what is shown in FIGS. 3-4 and FIGS. 11-12. For example, the horizontal length of the manifold separator may be longer or shorter than the horizontal length of the condenser and/or the longitudinal axis of the manifold separator may or may not be parallel to the longitudinal axis of the condenser bank.

Figure 2:
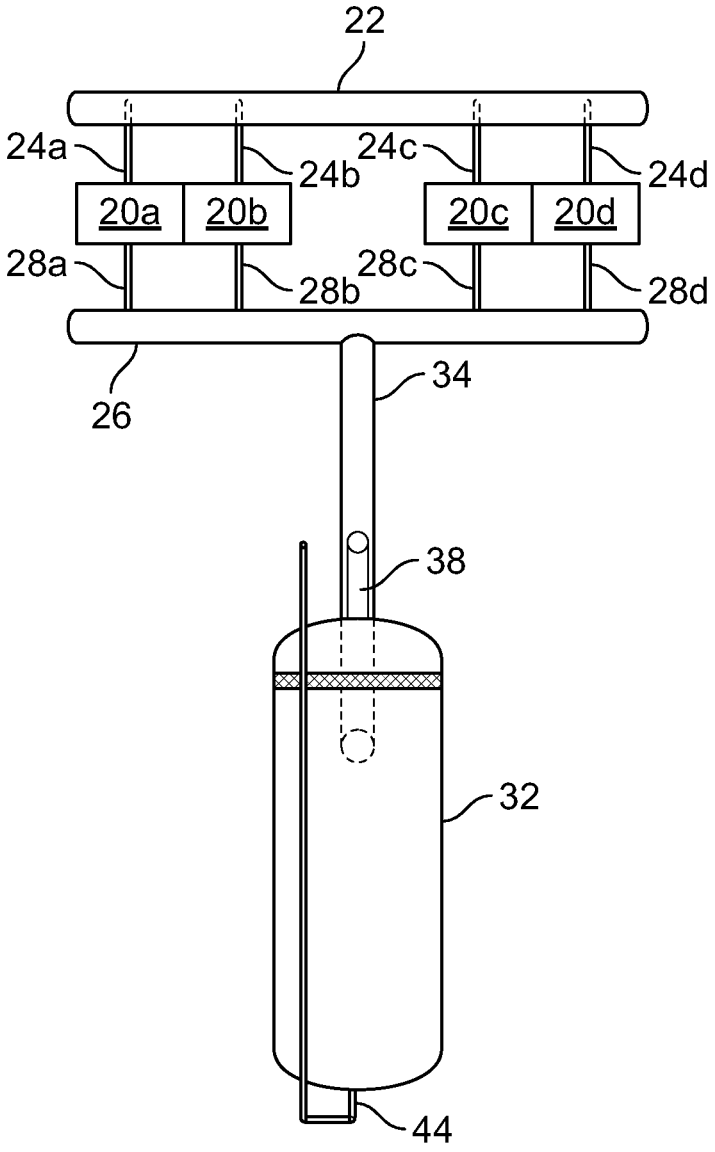
Fig. 2 (Prior Art)
FIG. 2 is a front view of the process flow diagram and schematic of FIG. 1.

While achieving the same or similar vapor/liquid separation as the system of FIGS. 1 and 2, some benefits of the embodiments of the invention described above are as follows: 1) plot layout can be simplified, 2) pressure drop in the mixed refrigerant compression circuit can be reduced, thus reducing compression power requirements, 3) total system metal mass and cost can be reduced, 4) the mixed refrigerant liquid surge drums can be readily placed inside a cold box.

While the preferred embodiments of the disclosure have been shown and described, it will be apparent to those skilled in the art that changes and modifications may be made therein without departing from the spirit of the disclosure, the scope of which is defined by the following claims.

What is claimed is:

1. A system for condensing and phase separating a refrigerant fluid comprising:

a. a condenser inlet header configured to receive a stream of refrigerant vapor and having a condenser header outlet;

b. a condenser having a vapor inlet in fluid communication with the condenser header outlet and a plurality of mixed phase outlets, said condenser configured to receive vapor through the vapor inlet and produce mixed phase fluid streams that exit the condenser through the plurality of mixed phase outlets;

c. a cylindrical manifold separator having a first manifold separator end and a second manifold separator end with a manifold separator longitudinal axis extending from the first manifold separator end to the second manifold separator end and including a plurality of mixed phase inlets in fluid communication with the plurality of mixed phase outlets of the condenser, said manifold separator configured to separate mixed phase fluid received through the plurality of mixed phase inlets into vapor and liquid and including a plurality of manifold separator vapor outlets through which resulting vapor streams exit the manifold separator and a plurality of manifold separator liquid outlets through which resulting liquid streams exit the manifold separator;

d. a cylindrical vapor collection header having a first vapor collection header end and a second vapor collection header end with a vapor collection header longitudinal axis extending from the first vapor collection header end to the second vapor collection header end, a first vapor stream inlet positioned adjacent to the first vapor collection header end and a second vapor stream inlet positioned adjacent to the second vapor collection header end, said first and second vapor stream inlets configured to receive vapor streams from the plurality of manifold separator vapor outlets, said vapor collection header further including a vapor collection header outlet positioned between the first and second vapor stream inlets inlets with respect to the vapor collection header longitudinal axis;

e. a cylindrical liquid collection header having a first liquid collection header end and a second liquid collection header end with a liquid collection header longitudinal axis extending from the first liquid collection header end to the second liquid collection header end, a first liquid stream inlet positioned adjacent to the first liquid collection header end therein and a second liquid collection header end portion with a second liquid stream inlet positioned adjacent to the second liquid collection header end, said first and second liquid stream inlets configured to receive liquid streams from the plurality of manifold separator liquid outlets, said liquid collection header further including a liquid collection header outlet positioned between the first and second liquid stream inlets inlets with respect to the liquid collection header longitudinal axis;

f. said manifold separator longitudinal axis, said vapor collection header longitudinal axis and said liquid collection header longitudinal axis being parallel to one another.

2. The system of claim 1 further comprising:

g. a liquid surge vessel having an inlet configured to receive a liquid stream from the liquid collection header outlet, said liquid surge vessel further including a surge vessel liquid outlet.

3. The system of claim 2 further comprising a pressure equalization line extending between and in fluid communication with a headspace of the liquid surge vessel and the vapor collection header or a line extending from the vapor collection header outlet.

4. The system of claim 1 wherein the plurality of mixed phase inlets of the manifold separator are each provided with a separator inlet device.

5. The system of claim 4 wherein each separator inlet device includes a baffle plate separator.

6. The system of claim 4 wherein each separator inlet device includes a half pipe separator.

7. The system of claim 1 wherein each vapor outlet of the manifold separator includes a vapor/liquid disengagement device.

8. The system of claim 1 wherein each of the plurality of manifold separator liquid outlet includes a baffle positioned within the manifold separator.

9. The system of claim 8 wherein each baffle includes a planar baffle plate that is positioned entirely in a plane perpendicular to the longitudinal axis of the manifold separator and over and across a corresponding one of the plurality of manifold separator liquid outlets.

10. The system of claim 9 wherein each baffle plate includes a cutout over the corresponding one of the plurality of manifold separator liquid outlets.

11. The system of claim 1 wherein the vapor and liquid outlets of the manifold separator are positioned between at least two of the plurality of mixed phase inlets.

12. The system of claim 1 wherein the condenser is an air-cooled heat exchanger.

13. The system of claim 12 wherein the condenser includes a plurality of tube bundles with each of the plurality of tube bundles having a line and connected to a corresponding one of the plurality of mixed phase inlets in the manifold separator.

14. The system of claim 13 wherein the plurality of tube bundles includes at least four tube bundles and the manifold separator has at least four of the plurality of mixed phase inlets where a first spacing between a first one of the plurality of mixed phase inlets and a second one of the plurality of mixed phase inlets differs from a second spacing between the second one of the plurality of mixed phase inlets and a third one of the plurality of mixed phase inlets but where the first spacing is the same as a third spacing between the third one of the plurality of mixed phase inlets and a fourth one of the plurality of mixed phase inlets.

15. A liquefaction system comprising:

a. a liquefaction heat exchanger having one or more refrigeration passages, a warm end and a cold end, said liquefaction heat exchanger configured to receive a feed gas at the warm end, liquefy the gas, and dispense the liquefied gas from the cold end;

b. a compression system including:

i) a compressor;

ii) a condenser inlet header configured to receive a stream of vapor from the compressor and having a condenser header outlet;

iii) a condenser having a vapor inlet in fluid communication with the condenser header outlet and a plurality of mixed phase outlets, said condenser configured to receive vapor through the vapor inlet and produce mixed phase fluid streams that exit the condenser through the plurality of mixed phase outlets;

iv) a cylindrical manifold separator having a first manifold separator end and a second manifold separator end with a manifold separator longitudinal axis extending from the first manifold separator end to the second manifold separator end and including a plurality of mixed phase inlets in fluid communication with the plurality of mixed phase outlets of the condenser, said manifold separator configured to separate mixed phase fluid received through the plurality of mixed phase inlets into vapor and liquid and including a plurality of manifold separator vapor outlets through which resulting vapor streams exit the manifold separator and a plurality of manifold separator liquid outlets through which resulting liquid streams exit the manifold separator;

v) a cylindrical vapor collection header having a first vapor collection header end and a second vapor collection header end with a vapor collection header longitudinal axis extending from the first vapor collection header end to the second vapor collection header end, a first vapor stream inlet positioned adjacent to the first vapor collection header end and a second vapor stream inlet positioned adjacent to the second vapor collection header end, said first and second vapor stream inlets configured to receive vapor streams from the plurality of manifold separator vapor outlets, said vapor collection header further including a vapor collection header outlet positioned between the first and second vapor stream inlets and in fluid communication with one of the one or more refrigeration passages of the liquefaction heat exchanger;

vi) a cylindrical liquid collection header having a first liquid collection header end and a second liquid collection header end with a liquid collection header longitudinal axis extending from the first liquid collection header end to the second liquid collection header end, a first liquid stream inlet positioned adjacent to the first liquid collection header end and a second liquid stream inlet positioned adjacent to the second liquid collection header end, said first and second liquid stream inlets configured to receive liquid streams from the plurality of manifold separator liquid outlets, said liquid collection header further including a liquid collection header outlet positioned between the first and second liquid stream inlets and in fluid communication with one of the one or more refrigeration passages of the liquefaction heat exchanger;

vii) said manifold separator longitudinal axis, said vapor collection header longitudinal axis and said liquid collection header longitudinal axis being parallel to one another.

16. The liquefaction system of claim 15 further comprising a liquid surge vessel having an inlet configured to receive a liquid stream from the liquid collection header outlet, said liquid surge vessel further including a surge vessel liquid outlet in fluid communication with one of the one or more refrigeration passages of the heat exchanger.

* * * * *